US006050908A

United States Patent [19]

Muhlhausen

[11] Patent Number: 6,050,908

[45] Date of Patent: Apr. 18, 2000

[54] TRAINING BAT

[76] Inventor: Harry B. Muhlhausen, 313 E. Wayside, Wharton, Tex. 77488

[21] Appl. No.: 09/079,718

[22] Filed: May 15, 1998

[51] Int. Cl.[7] ..... A63B 69/00

[52] U.S. Cl. ..... 473/457; 473/520; 473/566; 473/564

[58] Field of Search ..... 473/457, 564, 473/565, 566, 567, 568

[56] References Cited

U.S. PATENT DOCUMENTS

| | | | |
|---|---|---|---|
| 514,420 | 2/1894 | Jacobus | 473/564 |
| 3,173,688 | 3/1965 | Green | 473/568 |
| 3,246,894 | 4/1966 | Salisbury | 273/26 |
| 3,921,976 | 11/1975 | Lane | 473/458 |
| 4,274,631 | 6/1981 | Hayazaki | 473/457 |
| 4,399,996 | 8/1983 | Boyce | 273/26 B |
| 4,555,111 | 11/1985 | Alvarez | 273/26 B |
| 4,682,773 | 7/1987 | Pomilia | 273/26 B |
| 4,898,386 | 2/1990 | Anderson | 273/26 |
| 4,907,800 | 3/1990 | Passamaneck et al. | 473/457 |
| 4,951,948 | 8/1990 | Peng | 473/520 |
| 5,014,984 | 5/1991 | Brockhoff | 473/457 |
| 5,133,551 | 7/1992 | Handy et al. | 473/567 |
| 5,219,164 | 6/1993 | Peng | 473/520 |
| 5,360,209 | 11/1994 | Mollica | 273/26 |
| 5,511,777 | 3/1996 | McNeely | 473/520 |
| 5,516,097 | 5/1996 | Huddleson | 473/457 |
| 5,772,541 | 6/1998 | Buiatti | 473/520 |
| 5,785,617 | 7/1998 | MacKay, Jr. | 473/566 |
| 5,820,438 | 10/1998 | Horton, III | 446/213 |

*Primary Examiner*—Jeanette Chapman
*Assistant Examiner*—M. Chambers
*Attorney, Agent, or Firm*—Joseph N. Breaux

[57] ABSTRACT

A training bat having a handle member with a shock absorbing coupler and at least one detachable elongated contact surface member coupled in the shock absorbing coupler wherein the at least one detachable elongated contact surface member has a width significantly less than the width of a regular bat to enhance the eye-to-hand coordination to contact a pitched ball with such at least one detachable elongated contact surface member having such reduced width. The shock absorbing coupler serves to absorb shock forces imparted to the batter's hands gripping the handle member when the ball is contacted (hit). Thereby, the stinging felt in the batter's hands after contacting the ball is significantly minimize.

9 Claims, 3 Drawing Sheets

TRAINING BAT

TECHNICAL FIELD

The present invention relates to training bats and, more particularly, to a training bat having a handle member with a shock absorbing coupler and a detachable elongated contact surface member coupled in the shock absorbing coupler wherein the detachable elongated contact surface member has a width significantly less than the width of a regular bat to enhance the eye-to-hand coordination to contact a pitched ball with such detachable elongated contact surface member having such reduced width. The shock absorbing coupler serves to absorb shock forces imparted to the batter's hands gripping the handle member when the ball is contacted (hit). Thereby, the stinging felt in the batter's hands after contacting the ball is significantly minimized.

BACKGROUND OF THE INVENTION

Typically, baseball players practice contacting (hitting) a pitched baseball to increase their batting speed, eye-to-hand coordination for hitting a pitched bail in flight, ball control after contact and the probability of hitting the ball. Therefore, several training bats have been designed to enhance a baseball player's batting technique.

However, I have determined that when the batter is practicing contacting the ball with bats, shock forces are imparted to the batter's hands gripping the handle of the bat causing stinging and numbness, especially, when repeatedly contacting the ball. Therefore, the firm grip of the batter's hands around the bat's handle is comprised.

Several devices have been patented which are aimed at training bats.

U.S. Pat. No. 5,360,209, by Mollica, entitled "BATTING TRAINING DEVICE" discloses a batting training device which includes a handle and a weighted member movable relative to the handle along a longitudinal extending rod in response to the acceleration of the batting training device along a portion of a contact hitting swing.

U.S. Pat. No. 4,898,396, by Anderson, entitled "TRAINING BAT" discloses a training bat comprising a hollow cylindrical bat having a handle and a striking end. A disk is positioned in the interior of the bat at substantially the center of the bat. Additionally, a plate is positioned in the interior of the bat at the end of the striking end of the bat. An object is slidably coupled in the interior of the bat between the disk and plate. The training bat is essentially shaped in the form of a conventional bat. A weight is coupled within the training bat wherein the weight extends from the disk toward the end of the bat in close proximity to the handle. The weight is coupled to a resilient member so that the resilient member bears weight against the weight to keep the weight from moving.

U.S. Pat. No. 4,682,773, by Pomilia, entitled "BASEBALL TRAINING BAT" discloses a bat having a uniform outside diameter, the entire length thereof. The bat is essentially an elongated tubular member made of iron pipe material commonly referred to as ¾ inch pipe. The bat is filled with foamed material.

U.S. Pat. No. 4,555,111, by Alvarez, entitled "PRACTICE BAT" discloses a practice bat comprising a handle portion and a weighted end portion interconnected by a resilient spring. When the bat is swung, the momentum of the weighted end portion will cause it to lag behind and then move ahead of a longitudinal at rest axis of the handle portion causing the player's wrists to break or bend.

U.S. Pat. No. 4,399,996, by Boyce, entitled "PRACTICE BAT" discloses a baseball practice bat which includes a head portion and a grip portion. The head portion and grip portion are bridged together via an articulating joint which provides connected flexure or resilience. Such articulating joint is formed by a still coil spring which is embedded in a potting resin such as an epoxy resin with a suitable hardener.

U.S. Pat. No. 3,246,894, by Salisbury, entitled "BASEBALL TRAINING BAT OR SIMILAR ARTICLE" discloses a bat having a generally cylindrical tapered barrel portion joined to a handle portion having a flared butt end joined together via a central section. The central section has a small diameter to minimize the hitting area. In one embodiment, the central section is a torsion bar which converts shock forces such as the impact of the ball on the barrel portion of the bat to prevent imparting of the shock forces to the hands of the batter on the handle portion.

It can be readily seen that there exists the continuing need for a training bat having a handle member with a shock absorbing coupler and a detachable elongated contact surface member coupled in the shock absorbing coupler wherein the detachable elongated contact surface member has a width significantly less than the width of a regular bat to enhance the eye-to-hand coordination to contact a pitched ball with such detachable elongated contact surface member having such reduced width. The shock absorbing coupler serves to absorb shock forces imparted to the batter's hands gripping the handle member when the ball is contacted (hit). Thereby, the stinging felt in the batter's hands after contacting the ball is significantly minimized.

As will be seen more fully below, the present invention is substantially different in structure, methodology and approach from that of the prior training bats.

SUMMARY OF THE INVENTION

The preferred embodiment of the training bat of the present invention solves the aforementioned problems in a straight forward and simple manner. What is provided is a training bat having a handle member with a shock absorbing coupler and a detachable elongated contact surface member coupled in the shock absorbing coupler wherein the detachable elongated contact surface member has a width significantly less than the width of a regular bat to enhance the eye-to-hand coordination to contact a pitched ball with such detachable elongated contact surface member having such reduced width. The shock absorbing coupler serves to absorb shock forces imparted to the batter's hands gripping the handle member when the ball is contacted (hit). Thereby, the stinging felt in the batter's hands after contacting the ball is significantly minimized.

The training bat of the present invention comprises: a detachable elongated contact surface member having a tubular member having a first outer diameter the entire length thereof, a rear end and a forward end; a handle member for having a central cylindrical member having a second outer diameter the entire length thereof, a flared butt end, and a shock absorbing coupler coupled to an end opposite said flared butt end for detachably coupling to said handle member said rear end of said detachable contact surface member.

The shock absorbing coupler comprises: a cylindrically shaped cavity, and a shock absorbing means secured in said cylindrical cavity for absorbing shock forces propagated along said detachable elongated contact surface member and for maintaining a longitudinal center axis of said detachable elongated contact surface member aligned with a longitudinal center axis of said handle member wherein said shock absorbing means has a hollow center defined by an inner diameter of said shock absorbing means for receiving therein said rear end of said detachable elongated contact surface member.

In view of the above, an object of the present invention is to provide a training bat with a plurality detachable elongated contact surface members wherein each detachable elongated contact surface member has a different length and weight, or diameter. Thereby, as the batter's batting technique, eye-to-hand coordination, and batting average increases, the training bat is capable of being adapting to further enhance the batter's technique and average. Moreover, the increased length and weight of each detachable elongated contact surface member allow the training bat to be adapted for varying ages, height and strengths of the batter.

Another object of the present invention is to provide a training bat with a handle member with a shock absorbing coupler wherein the shock absorbing coupler includes a shock absorbing means between the outer perimeter of the shock absorbing coupler and the rear end of the detachable elongated contact surface member coupled in the shock absorbing coupler. Preferably, the shock absorbing means is made of resilient epoxy resin material. More specifically, the shock forces created along the detachable elongated contact surface member when contacting (hitting) the ball ordinarily would be propagated in the handle member. Since the rear end of the detachable elongated contact surface member is surrounded by the shock absorbing means, as the shock forces propagate to the rear end of the detachable elongated contact surface member such shock forces are absorbed by the shock absorbing means. Thereby, little or no the shock forces are transferred to the handle member.

A further object of the present invention is to provide a training bat with a handle member having a shock absorbing coupler and a detachable elongated contact surface member wherein the shock absorbing buffer has sufficient structural strength, while flexible and resilient, to maintain the longitudinal center axis of the handle member and the longitudinal center axis of the detachable elongated contact surface member aligned.

It is a still further object of the present invention to provide a training bat with a handle member having a shock absorbing coupler for detachably coupling to the handle member the detachable elongated contact surface member wherein the shock absorbing coupled absorbs the shock forces imparted to the batter's hands gripping the handle member when the ball is contacted to minimize the sting sensation and numbness felt by the batter's hands as the ball is repeatedly contacted (hit) while practicing.

It is a still further object of the present invention to provide a training bat with a handle member having an outer perimeter diameter which is dimensioned approximately to the same dimension of a standard bat.

It is a still further object of the present invention to provide a training bat which includes an internal kicking element slidably coupled in the detachable elongated contact surface member to create a noise when the batter fully swings the training bat.

It is a still further object of the present invention to provide a training bat having a plurality of detachable elongated contact surface members to create a training bat with varying lengths from, approximately 22 inches to 36 inches.

It is a still further object of the present invention to provide a training bat having a plurality of detachable elongated contact surface members having an outer diameter between 1 inch to 1½ inches.

In view of the above objects, it is a feature of the present invention to provide training bat which is simple to manufacture.

Another feature of the present invention is to provide a training bat which is relatively simple structurally.

The above and other objects and features of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
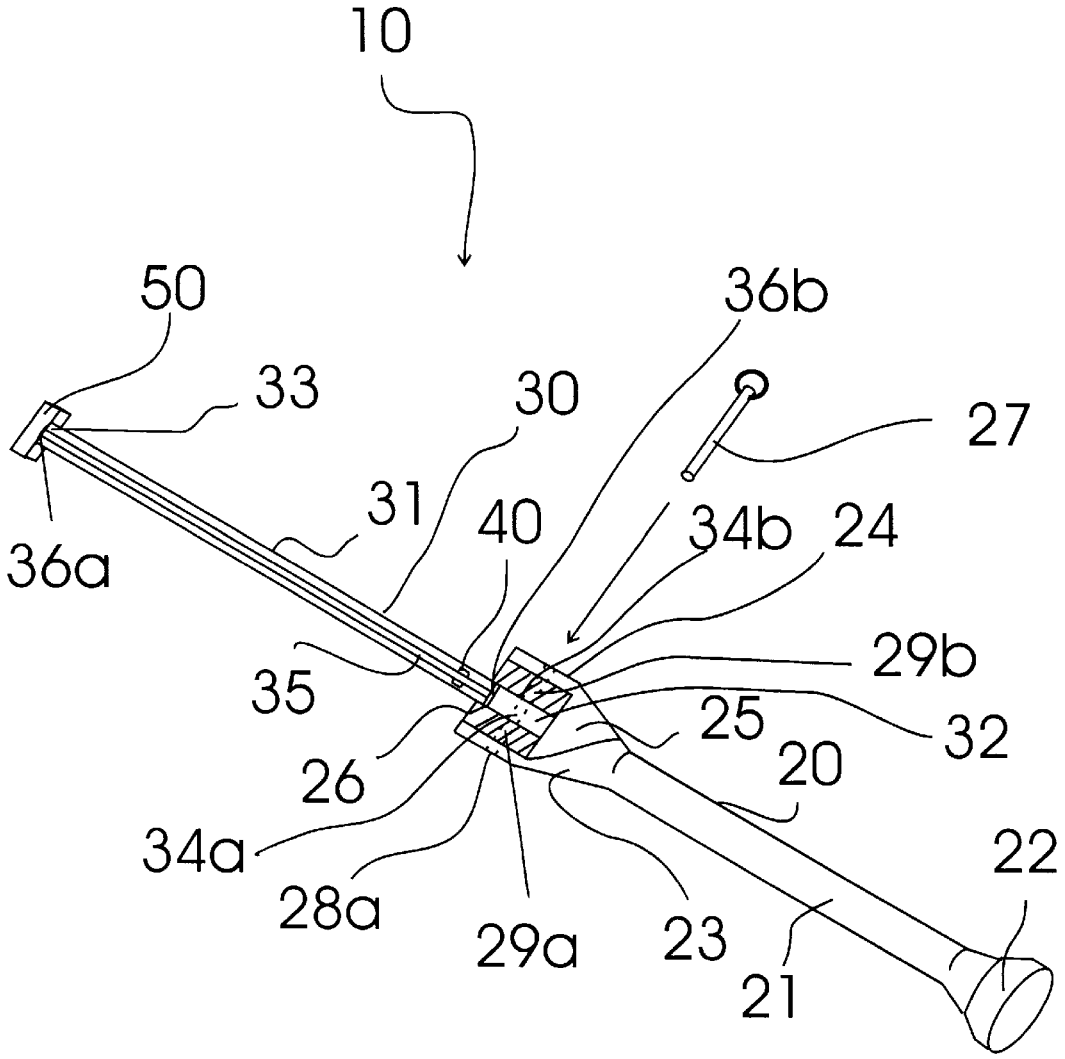
FIG. 1 illustrates a perspective view of the preferred embodiment of training bat of the present invention having a portion of the shock absorbing coupler and detachable elongated contact surface member shown in cross-section.

Referring now to the drawings, and in particular FIG. 1, the training bat of the present invention is designated generally by the numeral 10. Training bat 10 is comprised of handle member 20 at least one detachable elongated contact surface member 30, internal kicking element 40 and rubber cap 50.

Figure 3:
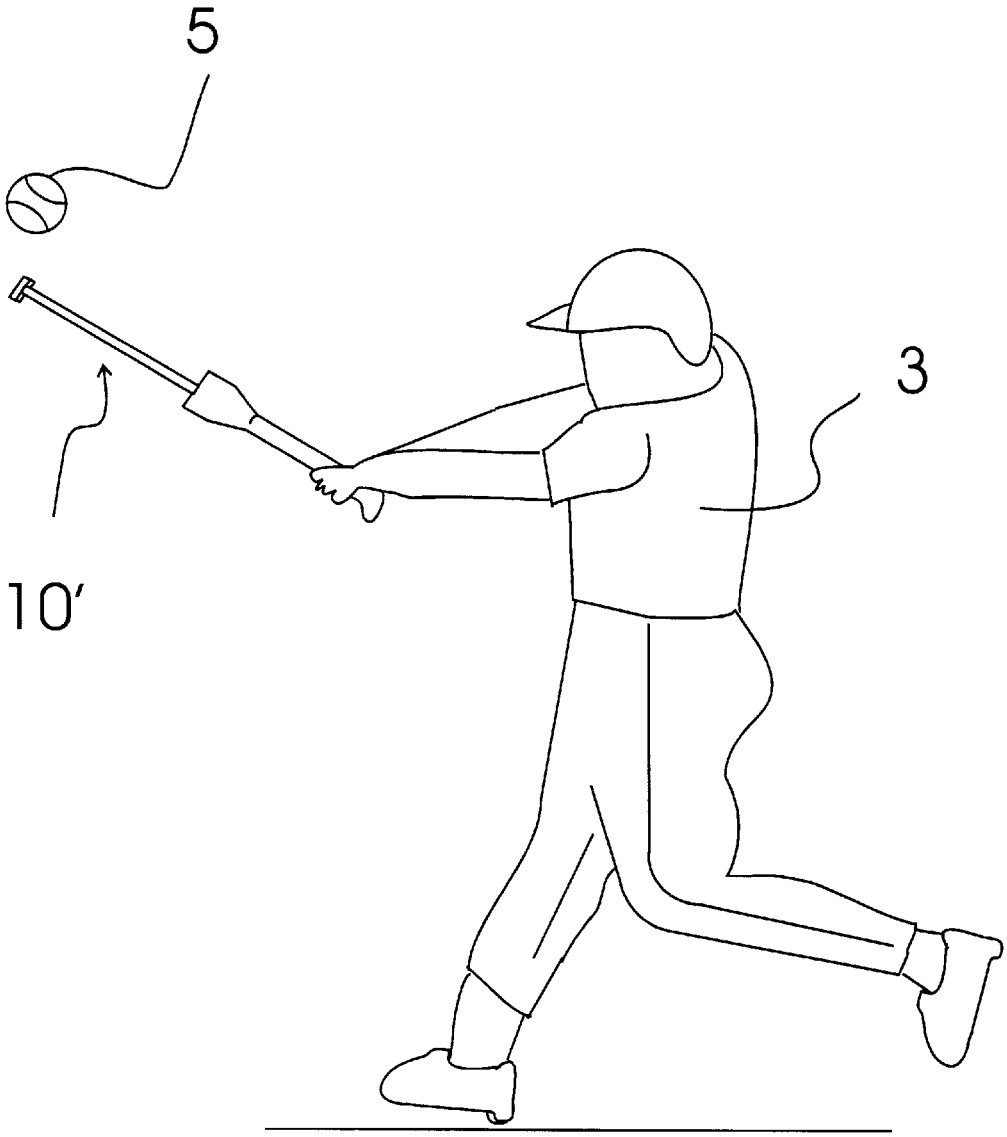

At least one detachable elongated contact surface member 30 comprises tubular member 31 having a relatively small outer diameter. In the exemplary embodiment, the small outer diameter is between 1 inch and 1⅓ inches. As can be appreciated, the reduced outer diameter of detachable elongated contact surface member 30 makes it more difficult for batter 3 to hit ball 5, as shown in FIG. 3. Tubular member 31 has rear end 32 and forward end 33 wherein tubular member 31 has a substantially constant outer diameter the entire length thereof.

In the preferred embodiment, the at least one detachable elongated contact surface member 30 is made of steel. Nevertheless, other durable materials may be substituted.

As shown in FIG. 1, rear end 32 of tubular member 31 is detachably coupled so handle member 20 wherein rear end 32 has first and second apertures 34*a* and 34*b* formed in the perimeter thereof wherein each aperture is spaced substantially 180° with respect to the other.

Forward end 33 of tubular member 31 has fixedly coupled thereto around the outer perimeter thereof rubber end cap 50. The rubber end cap 50 adds weight to forward end 33 of tubular member 31 of the at least one detachable elongated contact surface member 30.

Tubular member 31 is essentially hollow and has journalled along the longitudinal axis thereof shaft 35. Shaft 35 has one distal end coupled to wall 36*a* placed at the distal end of forward end 33 to enclose forward end 33 of tubular member 31. The other distal end of shaft 33 is fixedly coupled to wall 36*b* which is positioned above apertures 33*a* and 33*b* formed in rear end 32. The longitudinal center axis of shaft 35 is axially aligned with the longitudinal center axis of tubular member 31.

Internal kicking element 40 is slidably coupled on shaft 35 wherein, as training bat 10 is swung in the proper manner with the desired striking force, internal kicking element 40 is propelled toward wall 36*a* placed at the distal end of forward end 33 and strikes wall 36*a*. As internal kicking element 40 strikes wall 36*a*, a striking noise is heard by batter 3. The striking noise heard by the batter informs the batter that the batter 3 has swung training bat 10 with a sufficient force.

Handle member 20 comprises central cylindrical member 21 flared butt end 22 unitarily formed with the forward end of central cylindrical member 21 and shock absorbing coupler 23. The flared butt end 22 is essentially disc shaped and serves to prevent the hands of the batter from sliding off of cylindrical member 21. Cylindrical member 21 has a length which allows two hands to grip cylindrical member 21.

In the preferred embodiment, handle member 20 is made of aluminum. Nevertheless, other materials such as without limitation wood and durable plastic, may be substituted as desired. Furthermore, the outer diameter of central cylindrical member 21 of handle member 20, preferably, is substantially the same as the handle of conventional bats. Thereby, batter 3 can grip training bat 10 in the same manner as would be required for conventional bats since the outer diameters are essentially the same. Henceforth, the batting technique developed using training bat 10 of the present invention, is easily transferred to conventional bats especially since the manner gripping the bat is essentially the same.

Shock absorbing coupler 23 is unitarily coupled to the rear end of central cylindrical member 21. Shock absorbing coupler 23 comprises cylindrical cavity portion 24 and frusto conical portion 25 wherein the tapering profile of the frusto conical portion 25 tapers to the outer diameter of central cylindrical member 21.

Shock absorbing coupler 23 further comprises shock absorbing means 26 and securing means 27. Shock absorbing means 26 is adhered to the interior surface of cylindrical cavity portion 24 and serves to absorb the shock forces as the at least one detachable elongated contact surface member 30 contacts ball 5. Shock absorbing means 26 is tubular shaped. The hollow center of shock absorbing means 26 has an inner diameter slightly larger than the outer diameter of tubular member 31. Therefore, tubular member 31 may be received in shock absorbing means 26. For example, rear end 32 may be friction fit coupled in shock absorbing means 26 such that rear end 32 may be easily coupled in and removed from shock absorbing means 26.

In the preferred embodiment, shock absorbing means 26 is a resilient epoxy resin material, such as 3 M's Scotch-Weld EC-22/6B/A. More specifically, shock absorbing means 26 creates a resilient lining in cylindrical cavity portion 24 between the interior surface of cylindrical cavity portion 24 and the at least one detachable elongated contact surface member 30. The resilient lining (shock absorbing means 26) provides a buffer between rear end, 32 of tubular member 31 and the interior surface of cylindrical cavity portion 24 to minimize the shock forces felt in the hands, wrists and arms of the batter as ball 5 is contacted. Thereby, the stinging sensation felt by the batter's hands is significantly minimized.

As can be appreciated, a significant advantage of the shock absorbing means 26 is that batter 3 can repeated swing and hit ball 5 while practicing without compromising the grip of the batter. In other words, as batter 3 repeatedly hits ball 5, the stinging sensations felt in the batter's hands creates slight numbness. Since the shock absorbing means 26 absorbs the shock which would otherwise be strongly felt by batter 3 to cause such numbness, batter 3 can practice longer to develop the desired eye-hand coordination, upper body strength, and batting technique.

Although, the epoxy resin material is flexible and resilient, the epoxy resin material has sufficient structural strength to maintain the longitudinal center axis of the at least one detachable elongated contact surface members 30 axially align which the longitudinal center axis of central cylindrical member 21 even after ball 5 is contacted by the at least one elongated contact surface member 30.

Cylindrical cavity portion 24 has formed in the perimeter thereof first and second apertures 28*a* and 28*b*. Moreover, shock absorbing means 26 has formed therein first and second channels 29*a* and 29*b* wherein the longitudinal axis of first channel 29*a* and the longitudinal axis of second channel 29*b* are aligned with the center of first and second apertures 28*a* and 28*b*, respectively, and the center of first and second apertures 34*a* and 34*b*, respectively. Henceforth, a clear path is provided through cylindrical cavity portion 24.

As shown in FIG. 1, securing means 27 comprises a locking pin. Locking pin 29 is journalled through first and second apertures 28*a* and 28*b* of cylindrical cavity portion 24, first and second channels 29*a* and 29*b* of shock absorbing means 26, and first and second apertures 34*a* and 34*b* of tubular member 31. When locking pin 29 is removed, detachable elongated contact surface member 30 is capable of being removed from shock absorbing coupler 23. Thereby, different elongated contact surface members 30 of varying weights and lengths may be substituted.

Figure 2:
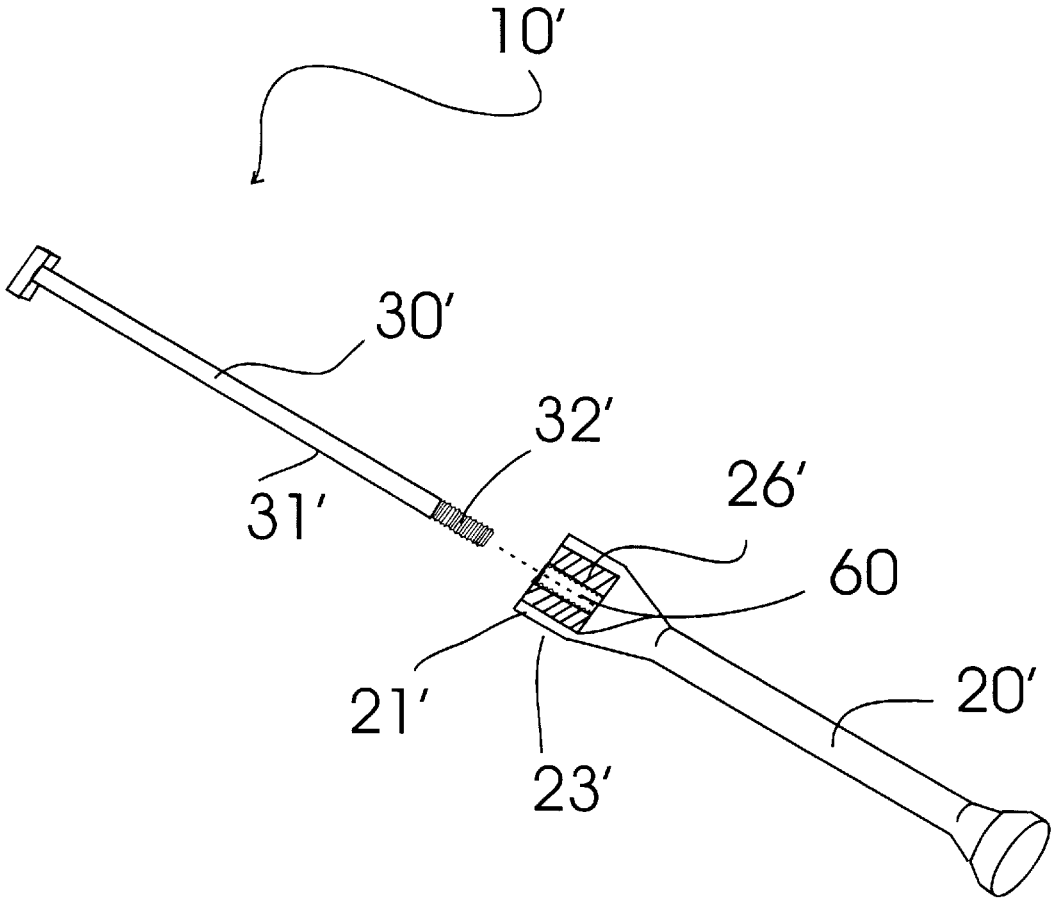
FIG. 2 illustrates an exploded view of the training bat of an alternate embodiment having a portion of the shock absorbing coupler shown in cross section; and, FIG. 3 illustrates the training bat of FIG. 2 in use.

Referring now to FIG. 2, training bat 10' differs from training bat 10 of the embodiment of FIG. 1 only in that the outer perimeter of rear end 32' is threaded and is detachably coupled to handle member 20' via threaded coupling member 60 fixedly coupled in central cylindrical member 21'. Threaded coupling remember 60 is fixedly coupled to the inner diameter of absorbing means 26'.

Threaded rear end 32' is detachably coupled to threaded coupling member 60. The longitudinal axis of threaded coupling member 60 is axially aligned with the longitudinal axis of central cylindrical member 21' of handle member 20'. Thereby, as detachable elongated contact surface member 30' is secured to shock absorbing coupler 23', the longitudinal center axis of tubular member 31' of detachable elongated contact surface member 30' is maintained aligned with the longitudinal center axis of central cylindrical member 21' of handle member 20'.

In operation, as ball 5 is contacted by detachable elongated contact surface member 30 or 30' the ball is propelled forwardly. Since rear end 32 or 32' of detachable elongated contact surface member 30 or 30' is surrounded by shock absorbing means 26 or 26', as the shock forces propagate to rear end 32 or 32' of detachable elongated contact surface member 30 or 30' such shock forces are absorbed by shock absorbing means 26 or 26'. Thereby, little or no the shock forces are transferred to the handle member 20 or 20'.

As can be appreciated, shock absorbing means 26 or 26' should have a sufficient thickness defined by the distance between the inner diameter and the outer diameter to absorb the shock forces.

It is noted that the embodiment of the training bat described herein in detail, for exemplary purposes, is of course subject to many different variations in structure, design, application and methodology. Because many varying and different embodiments may be made within the scope of the inventive concept (s) herein taught, and because many modifications may be made in the embodiment herein detailed in accordance with the descriptive requirements of the law, it is to be understood that the details herein are to be interpreted as illustrative and not in a limiting sense.

What is claimed is:

1. A training bat consisting solely of:

a detachable elongated contact surface member consisting solely of a tubular member having a first outer diameter the entire length thereof, a rear end and a forward end;

a handle member for having a central cylindrical member having a second outer diameter the entire length thereof, a flared butt end, and a shock absorbing coupler coupled to an end opposite said flared butt end for detachably coupling to said handle member said rear end of said detachable contact surface member wherein said shock absorbing coupler comprises:

a cylindrically shaped cavity, and a shock absorbing means secured in said cylindrical cavity for absorbing shock forces propagated along said detachable elongated contact surface member and for maintaining a longitudinal center axis of said detachable elongated contact surface member aligned with a longitudinal center axis of said handle member wherein said shock absorbing means has a hollow center defined by an inner diameter of said shock absorbing means for receiving therein said rear end of said detachable elongated contact surface member.

2. The training bat of claim 1, further comprising:

a first end wall coupled in said detachable elongated contact surface member to said forward end of said detachable elongated contact surface member;

a second end wall coupled in said detachable elongated contact surface member in close proximity to said rear end of said detachable elongated contact surface member;

a shaft coupled along said longitudinal center axis of said detachable elongated contact surface member between said first end wall and said second end wall; and, internal kicking element slidably coupled to said shaft.

3. The training bat of claim 1, wherein said shock absorbing means is made of resilient and flexible epoxy resin material with structural strength to maintain said longitudinal center axis of said detachable elongated contact surface member aligned with said longitudinal center axis of said handle member.

4. The training bat of claim 3, further comprising a securing means for securing said rear end of said detachable elongated contact surface member in said cylindrical cavity.

5. The training bat of claim 4, wherein said securing means comprises a locking pin.

6. The training bat of claim 4, wherein said rear end of said detachable elongated contact surface member is threaded and said securing means comprises a threaded coupler fixed coupled in shock absorbing means for matingly receiving therein the threaded rear end of said detachable elongated contact surface member.

7. The training bat of claim 1, further comprising a rubber cap member coupled to said forward end of said detachable elongated contact surface member.

8. The training bat of claim 1, wherein said first diameter of said detachable elongated contact surface member is between 1 inch and 1½ inches the entire length of said detachable elongated contact surface member.

9. The training bat of claim 1, wherein said handle member is made of aluminum.

* * * * *